US011058218B2

(12) United States Patent
An

(10) Patent No.: US 11,058,218 B2
(45) Date of Patent: Jul. 13, 2021

(54) GRID CABINET WITH VARIABLE SPACES

(71) Applicant: CHANGSHA XINGSHEN INTELLIGENT TECHNOLOGY CO., LTD, Hunan (CN)

(72) Inventor: Xiangjing An, Hunan (CN)

(73) Assignee: CHANGSHA XINGSHEN INTELLIGENT TECHNOLOGY CO., LTD, Hunan (CN)

( * ) Notice: Subject to any disclaimer, the term of this patent is extended or adjusted under 35 U.S.C. 154(b) by 0 days.

(21) Appl. No.: 16/651,360

(22) PCT Filed: Sep. 28, 2018

(86) PCT No.: PCT/CN2018/108315
§ 371 (c)(1),
(2) Date: Mar. 27, 2020

(87) PCT Pub. No.: WO2019/062847
PCT Pub. Date: Apr. 4, 2019

(65) Prior Publication Data

US 2020/0229592 A1 Jul. 23, 2020

(30) Foreign Application Priority Data

Sep. 29, 2017 (CN) ..... 201710905277.2

(51) Int. Cl.
*A47B 45/00* (2006.01)
*A47B 43/00* (2006.01)
(Continued)

(52) U.S. Cl.
CPC ..... *A47B 45/00* (2013.01); *A47B 43/00* (2013.01); *A47B 47/0091* (2013.01); *A47B 96/025* (2013.01)

(58) Field of Classification Search
CPC ..... A47B 45/00; A47B 43/00; A47B 96/025; A47B 87/0276; A47B 87/005;
(Continued)

(56) References Cited

U.S. PATENT DOCUMENTS 1,997,432 A * 4/1935 Replogle ..... F25D 25/02 211/153
3,547,507 A * 12/1970 Dorwin, Jr. ..... A47B 88/497 312/246
(Continued)

FOREIGN PATENT DOCUMENTS

CN 204378398 6/2015
CN 205143954 4/2016
(Continued)

OTHER PUBLICATIONS

English translation of CN204378398; 2015.*
(Continued)

*Primary Examiner* — Hiwot E Tefera
(74) *Attorney, Agent, or Firm* — JCIP Global Inc.

(57) ABSTRACT

A grid cabinet with variable spaces includes a cabinet body and a control part. The cabinet body is provided with two or more accommodating cavities, each of which is provided with at least one door and a door locking part. A separator is disposed between every adjacent accommodating cavities, the adjacent accommodating cavities are separated into respective independent spaces by the separators, and a separator locking part for fixing and locking the separator is provided in each accommodating cavity. Under control of the control part, the door locking parts of two or more adjacent accommodating cavities are opened synchronously, the separator locking parts are loosened, and the separators are operated so that the two or more adjacent accommodating cavities are communicated.

9 Claims, 9 Drawing Sheets

(51) Int. Cl.
*A47B 47/00* (2006.01)
*A47B 96/02* (2006.01)

(58) Field of Classification Search
CPC ..... A47B 87/0292; A47B 57/00; A47B 57/58; A47B 57/583; A47B 47/00; A47B 46/00; A47B 47/0091; G07C 9/00; G07C 9/00571; G07C 9/00912; A47F 5/10; A47F 5/005; F25D 2325/021; F25D 25/024
See application file for complete search history.

(56) References Cited

U.S. PATENT DOCUMENTS 4,867,513 A * 9/1989 Choi ..... A47B 43/00 312/258
2008/0231154 A1* 9/2008 Rudduck ..... E05B 65/46 312/333
2010/0026452 A1* 2/2010 Wilms ..... G07F 17/12 340/5.73
2013/0020922 A1* 1/2013 Jang ..... F25D 23/067 312/408
2015/0356801 A1* 12/2015 Nitu ..... G07C 9/00904 340/5.61
2016/0288955 A1* 10/2016 Wang ..... B65D 11/18
2017/0069148 A1* 3/2017 Gilbertson ..... G07C 9/00857
2017/0215578 A1 8/2017 Cole
2018/0220793 A1* 8/2018 Ng ..... A47B 43/00
2020/0381107 A1* 12/2020 Lowry ..... G06K 9/6288

FOREIGN PATENT DOCUMENTS

CN 106037278 10/2016
CN 106263615 1/2017
CN 107495635 12/2017

OTHER PUBLICATIONS

"International Search Report (Form PCT/ISA/210) of PCT/CN2018/108315", dated Jan. 2, 2019, with English translation thereof, pp. 1-4.

* cited by examiner

GRID CABINET WITH VARIABLE SPACES

CROSS-REFERENCE TO RELATED APPLICATION

This application is a 371 of international application of PCT application serial no. PCT/CN2018/108315, filed on Sep. 28, 2018, which claims the priority benefit of China application no. 201710905277.2, filed on Sep. 29, 2017. The entirety of each of the above mentioned patent applications is hereby incorporated by reference herein and made a part of this specification.

BACKGROUND

Technical Field

The present invention mainly relates to the fields of logistics, express and warehousing, in particular to a grid cabinet with variable spaces applicable to the fields of logistics, express and warehousing, etc.

Description of Related Art

With rapid development of the logistics and express industries, how to improve the delivery speed and safety of articles is a problem to be addressed urgently. Express cabinet (also can be logistics cabinet, warehousing cabinet) is the key to facing end users or serving as a transfer node.

The existing cabinet bodies are fixedly installed on the ground. Taking one common express cabinet in the residential areas for example, a plurality of storage cavities at different sizes are directly provided on most cabinet bodies, and a door for closing is provided for every storage cavity. A deliveryman will choose a proper storage cavity by the size of the goods, and then open the corresponding door for placing goods by an APP or other ways; anyone who picks up the goods will open the door for storing the goods to take away the goods based on a corresponding pickup code or APP.

The above traditional cabinet body is structurally convenient to operate, but still has some problems. Although the storage cavities on the cabinet body have different specifications, each specification is fixed, namely, the size of each grid space is fixed and thus cannot be adjusted. In other words, the limited number of storage cavities on the cabinet body cannot be found for some goods with special specifications at any time, which brings great difficulty to the distribution personnel, so that they cannot complete distribution. Furthermore, this causes great difficulty to intelligent distribution equipment. Moreover, large volume storage cavities are often used for storing small volume articles due to fixed specifications of the traditional storage cavities, so that the storage efficiency of entire cabinet body is very low.

SUMMARY

The technical problem to be solved by the present invention is that, the present invention, for the technical problem in the prior art, provides a grid cabinet with variable spaces which is simple in structure, convenient to operate and capable of optimizing the storage capacity.

In order to solve the technical problem above, the present invention develops the following technical solution.

A grid cabinet with variable spaces includes a cabinet body and a control part. The cabinet body is provided with two or more accommodating cavities for placing articles, each accommodating cavity is provided with at least one door, and a door locking part is disposed on each door. A separator is disposed between every adjacent accommodating cavities, the adjacent accommodating cavities are separated into respective independent spaces by the separators, and a separator locking part for fixing and locking the separator is provided in each accommodating cavity. Under control of the control part, the door locking parts of two or more adjacent accommodating cavities are opened synchronously, the separator locking parts are loosened, and the separators are operated so that the two or more adjacent accommodating cavities are communicated.

As further improvement of the present invention, the inner side walls of the accommodating cavities are provided with hanging parts for hanging the separators, and the separators are hung onto the hanging parts after the adjacent accommodating cavities are communicated.

As further improvement of the present invention, the separator is of a folded structure or a flexible rolling shutter structure. One end of the separator is secured onto an inside wall of the accommodating cavities, and the other end thereof are locked by the separator locking parts. When the separator locking part is opened under the control of the control part, the separator is folded to ensure that the adjacent accommodating cavities are communicated.

As further improvement of the present invention, the separators are driven to be folded by one drive part.

As further improvement of the present invention, the separator is of a splicing structure hinged with a plurality of boards. One end of the separator is secured onto an inside wall of the accommodating cavities, and the other end thereof is locked by the separator locking parts. When the separator locking part is opened under the control of the control part, the separator is folded by hinged joints to ensure that the adjacent accommodating cavities are communicated.

As further improvement of the present invention, the door locking part is an electromagnetic lock or a mechanical lock.

As further improvement of the present invention, the door locking part includes a lock cylinder and a lock catch, both of which are correspondingly disposed on the door or the cabinet body respectively. The lock cylinder is of a telescopic structure and is disposed on the cabinet body or the door, and under the control of the control part, the lock cylinder moves telescopically to match the lock catch for the purpose of finishing locking or opening action.

As further improvement of the present invention, the separator locking part is an electromagnetic lock, or a mechanical lock, or a manual connection component.

As further improvement of the present invention, the adjacent accommodating cavities are disposed sequentially in a horizontal direction, and the plurality of separators are disposed to form separation in a vertical direction; or the adjacent accommodating cavities are disposed sequentially in the vertical direction, and the plurality of separators are disposed to form separation in the horizontal direction, and are meanwhile to be taken as bearing plates for articles.

As further improvement of the present invention: the control part is directly arranged on the cabinet body; or the control part is used for controlling the separator locking parts and the door locking parts by means of remote control or cloud control.

Compared with the prior art, the present invention has the following advantages: the grid cabinet with variable spaces provided by the present invention is simple in structure and convenient to operate; the adjacent accommodating cavities on the cabinet body can be communicated or separated by operating the separators, which can change storage spaces, namely, the proper storage cavities can be used for maximally placing the articles with corresponding volumes. Therefore, this can greatly optimize the storage capacities, conform to the actual storage demands, and improve the storage efficiency. Meanwhile, the cabinet body provided by the present invention can be also extensively applicable to various occasions and environments.

DESCRIPTION OF THE EMBODIMENTS

Figure 1:
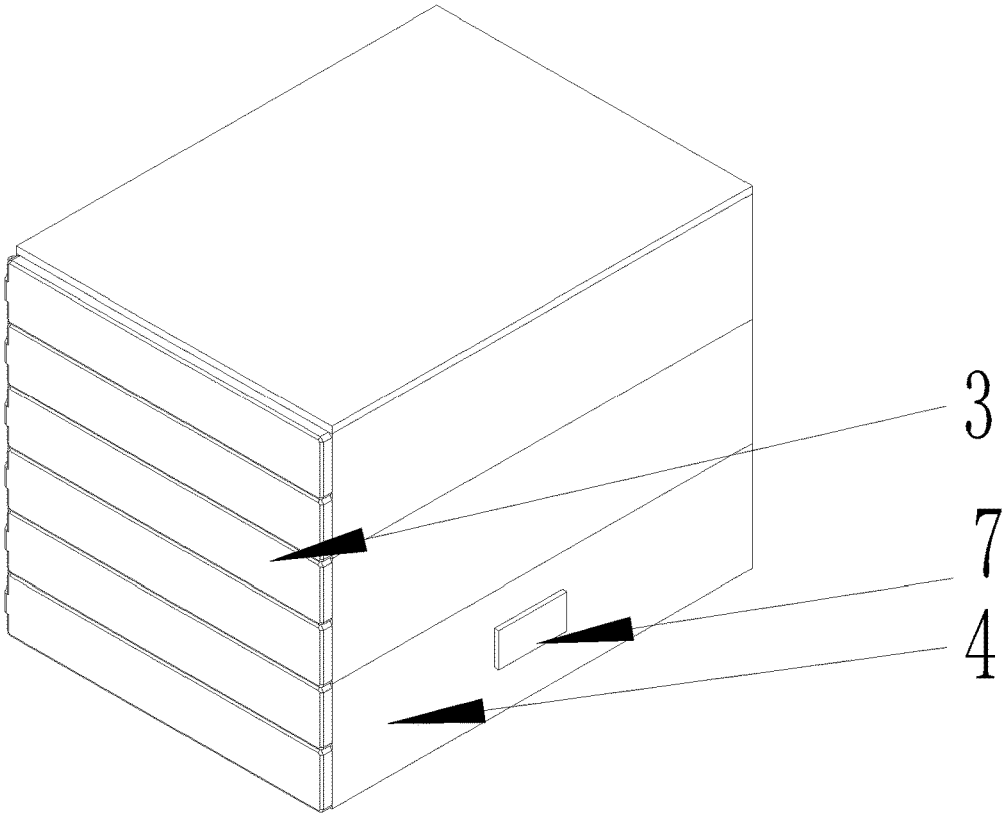
FIG. 1 illustrates a structural schematic diagram of the present invention in a specific application instance.
Figure 2:
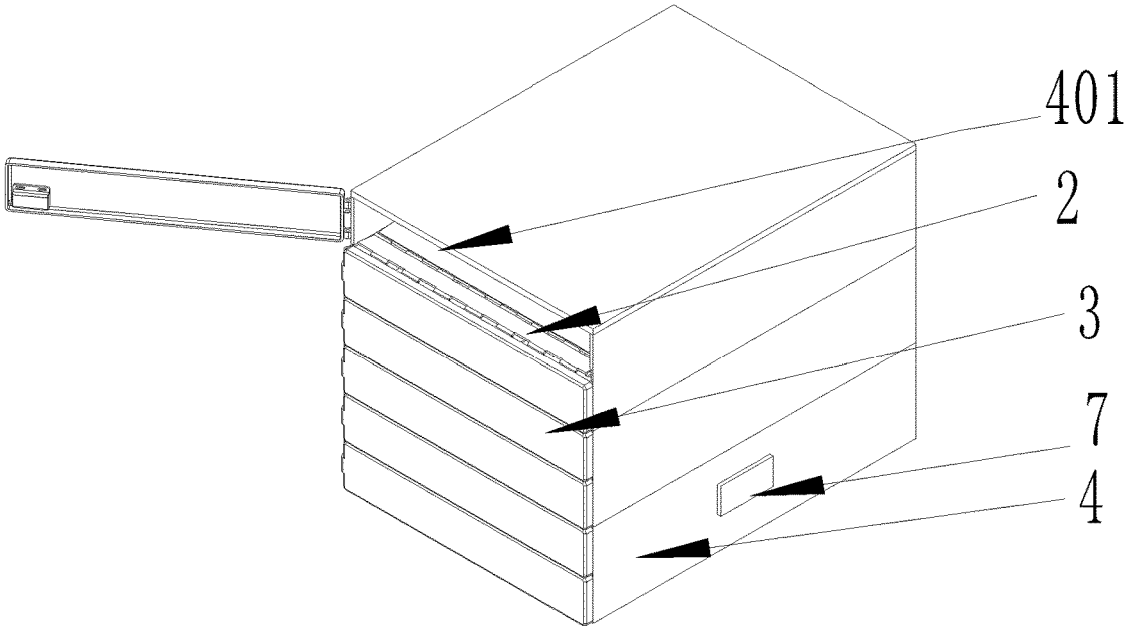
FIG. 2 illustrates a structural schematic diagram when single door is opened in a specific application instance.
Figure 3:
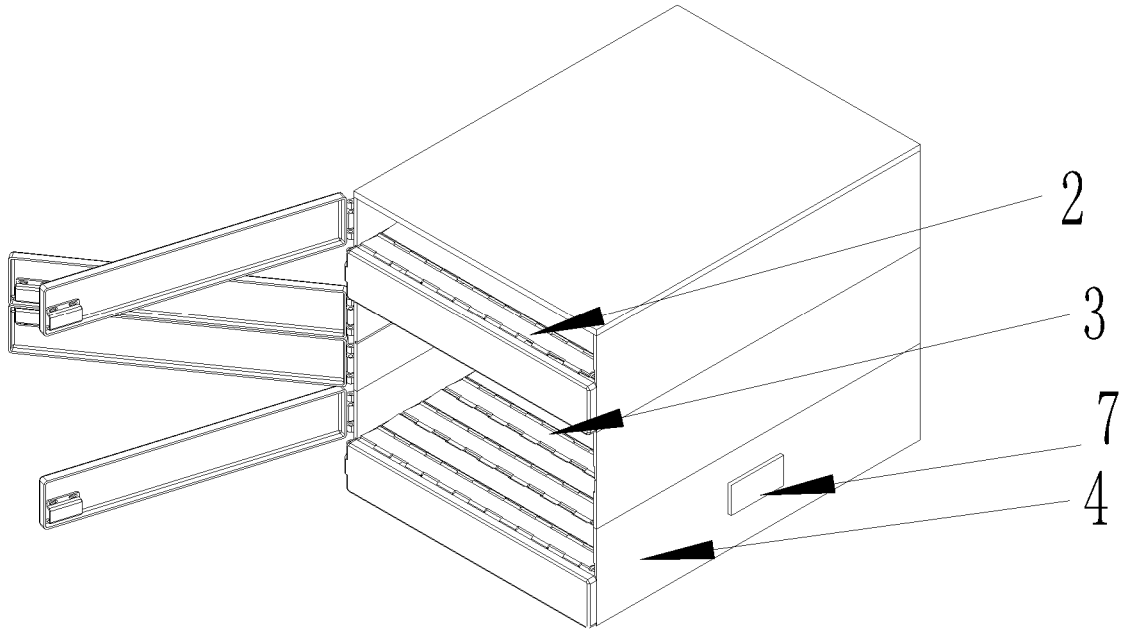
FIG. 3 illustrates a structural schematic diagram when single door and two adjacent doors are opened synchronously in a specific application instance.
Figure 4:
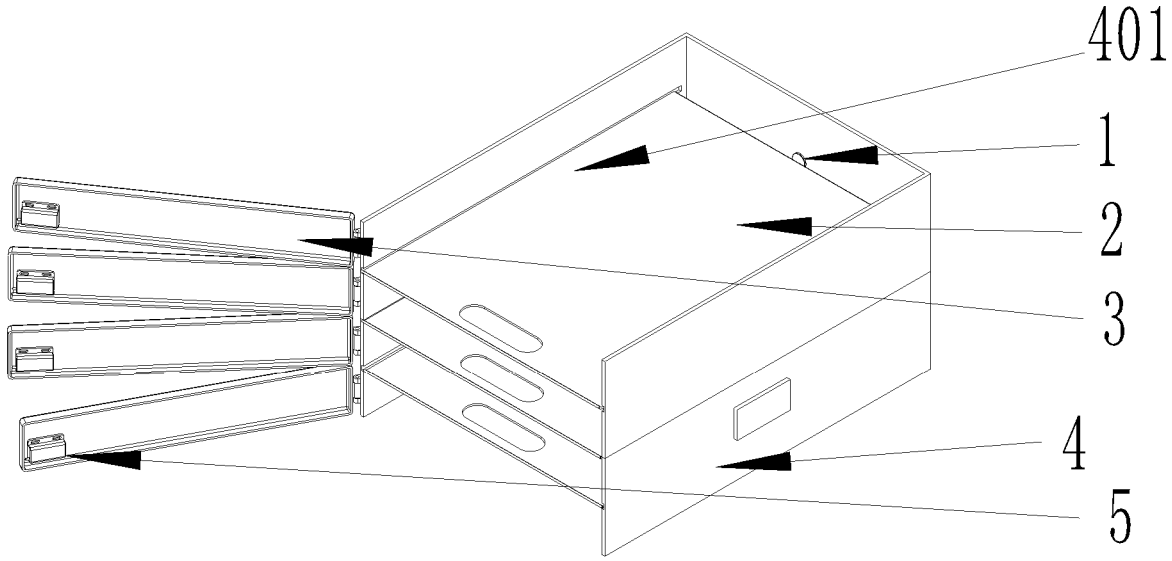
FIG. 4 illustrates a structural schematic diagram when a plurality of doors are opened synchronously in a specific application instance.

The present invention will be further clarified based on the following figures and embodiments.

As shown in FIG. 1 to FIG. 5, the grid cabinet with variable spaces provided by the present invention includes a cabinet body 4 and a control part 7. The cabinet body 4 is provided with two or more accommodating cavities 401 for placing articles, and each accommodating cavity 401 is provided with at least one door 3. A door locking part 5 is disposed on each door 3. When the door locking parts 5 are locked, the accommodating cavities 401 are closed by the doors 3. After the door locking parts 5 are loosened, the doors 3 are opened to make the accommodating cavities 401 open, so that the articles can be picked up and placed into the accommodating cavities 401. A separator 2 is provided between every adjacent accommodating cavities 401, and the adjacent accommodating cavities 401 are separated into respective independent spaces by the separators 2. Each accommodating cavity 401 is internally provided with a separator locking part 1 for fixing and locking the separator 2. Under the control of the control part 7, the door locking parts 5 of two or more adjacent accommodating cavities 401 can be opened synchronously, so that the two or more adjacent doors 3 are opened synchronously. After the separator locking parts 1 are loosened, the two or more adjacent accommodating cavities 401 are communicated, so that the storage spaces for the articles can be changed according to the needs.

In a specific application instance, an opening direction of the accommodating cavity 401 can be selected according to the actual needs, for instance, toward a direction far away from a wall, or toward the top or the bottom, so as to match pick-and-place functional parts (logistics vehicles, drones, etc.).

In a specific application instance, the adjacent accommodating cavities 401 that can be communicated are disposed sequentially in a horizontal direction, and a plurality of separators 2 are disposed to form separation in a vertical direction. Or in a specific application instance, the adjacent accommodating cavities 401 that can be communicated are disposed sequentially in a vertical direction, and a plurality of separators 2 are disposed to form separation, and meanwhile to be taken as bearing plates for the articles in a horizontal direction.

Figure 5:
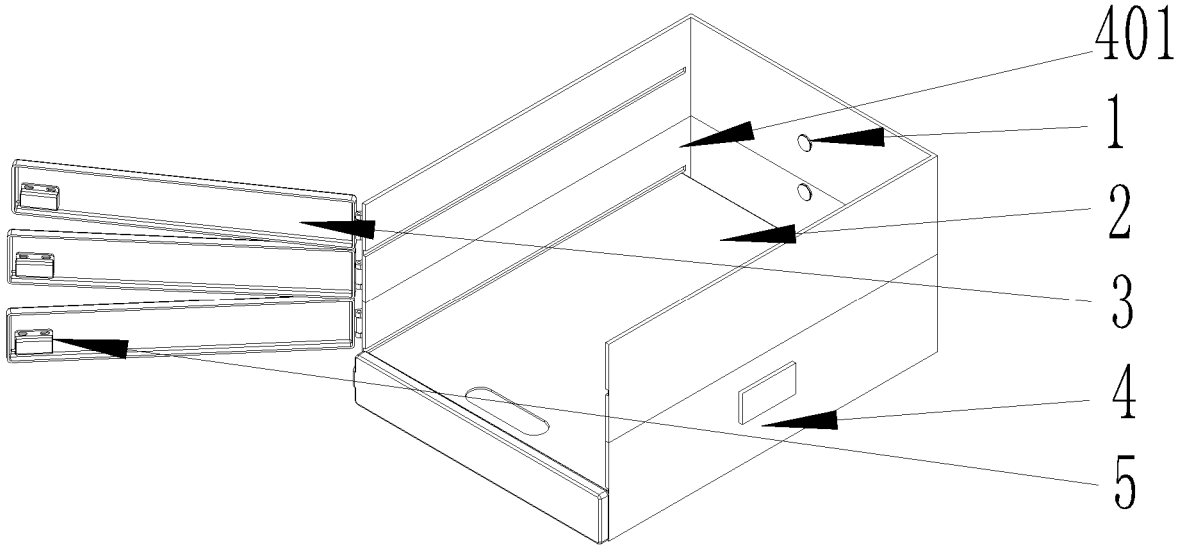
FIG. 5 illustrates a structural schematic diagram after a plurality of doors are opened synchronously and separators are removed in a specific application instance.
Figure 6:
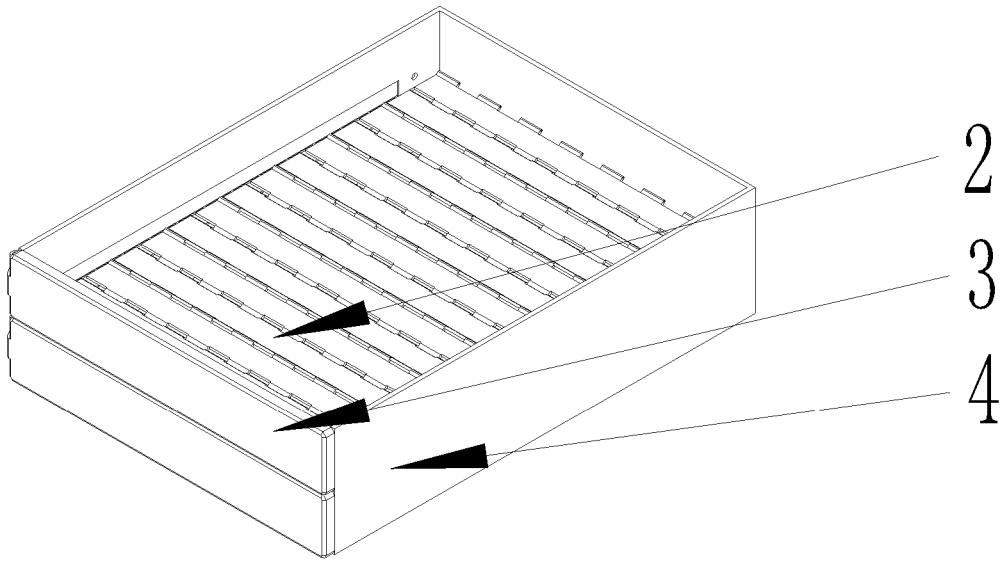
FIG. 6 illustrates a schematic diagram when separators are of a foldable structure in a specific application instance.
Figure 7:
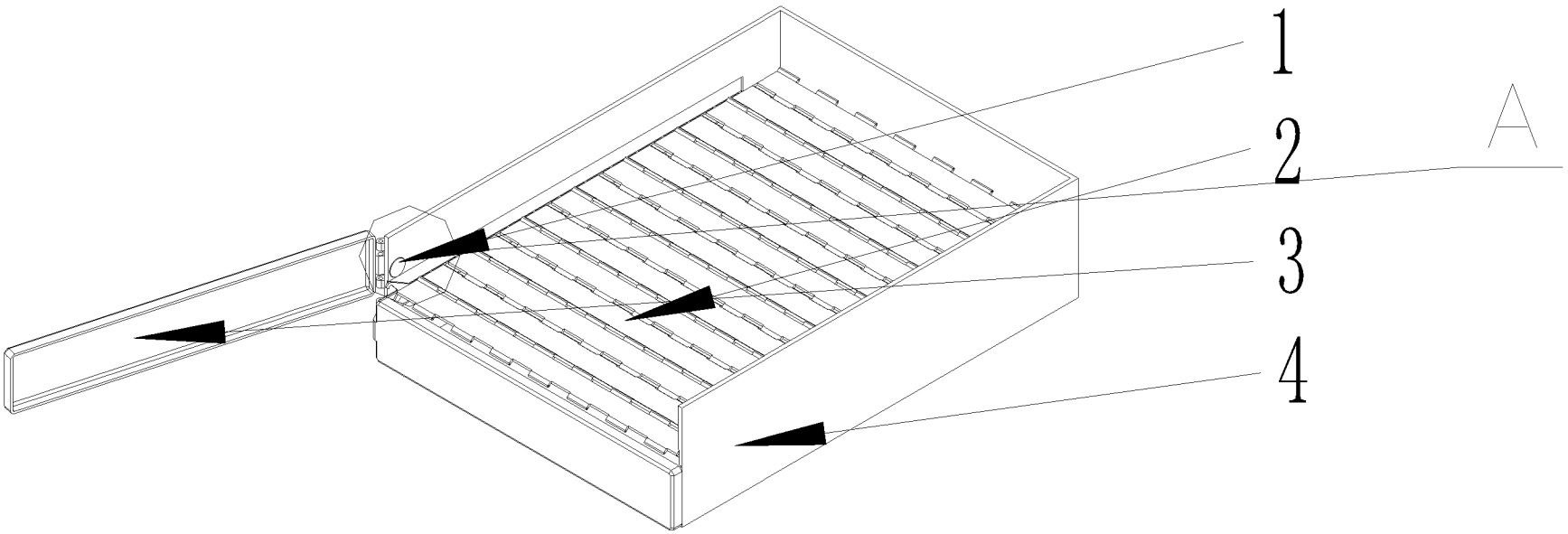
FIG. 7 illustrates a schematic diagram when separators are of a foldable structure and single door is opened in a specific application instance.
Figure 8:
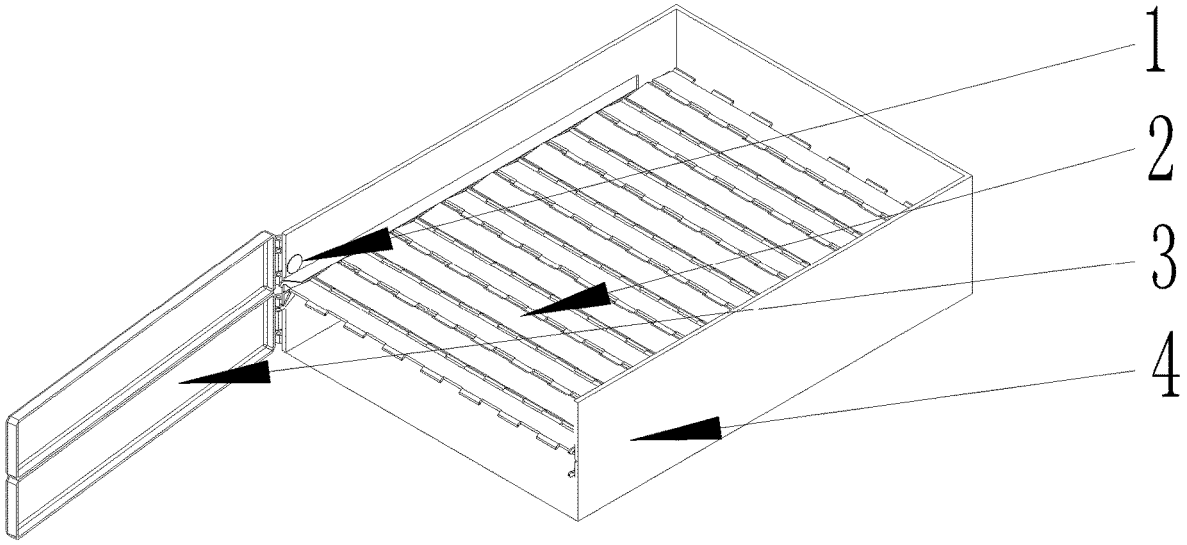
FIG. 8 illustrates a schematic diagram when separators are of a foldable structure and two adjacent doors are opened in a specific application instance.
Figure 9:
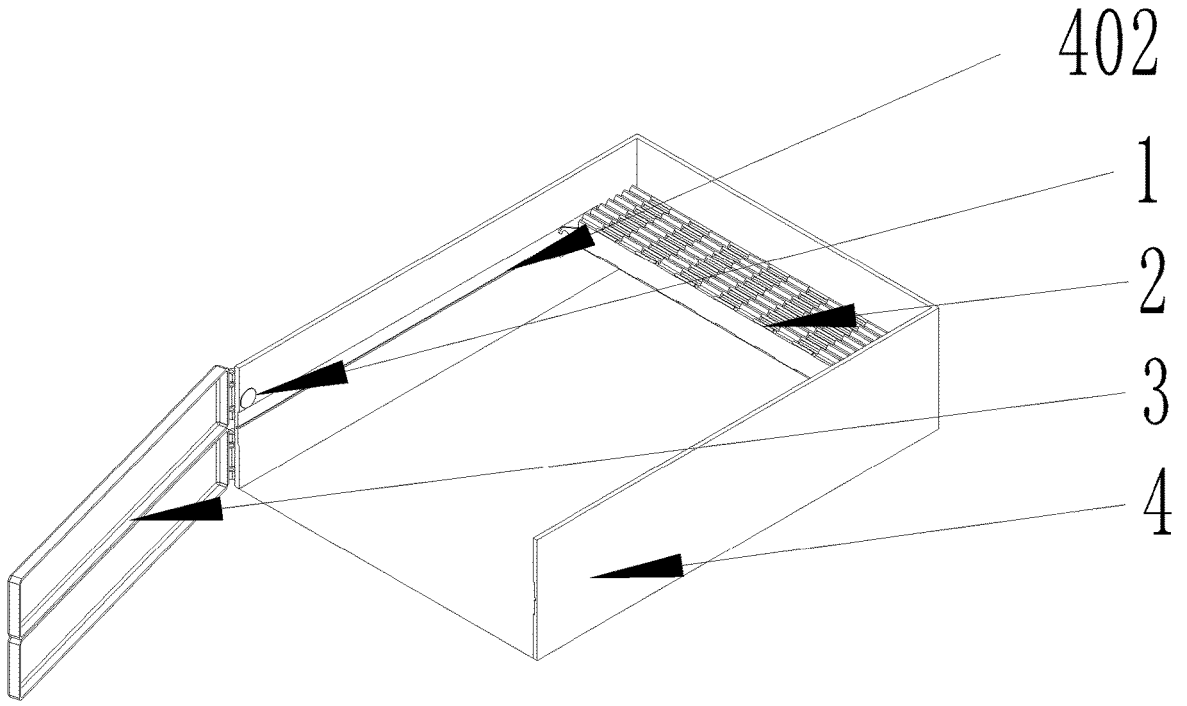
FIG. 9 illustrates a schematic diagram when separators are of a foldable structure and separators are folded in a specific application instance.
Figure 10:
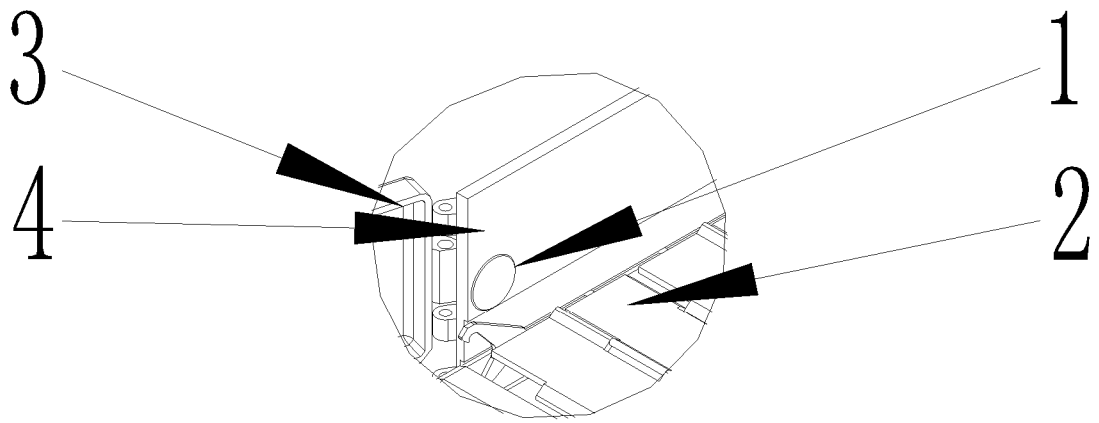
FIG. 10 illustrates a partial enlarged view of position A in FIG. 7.
Figure 11:
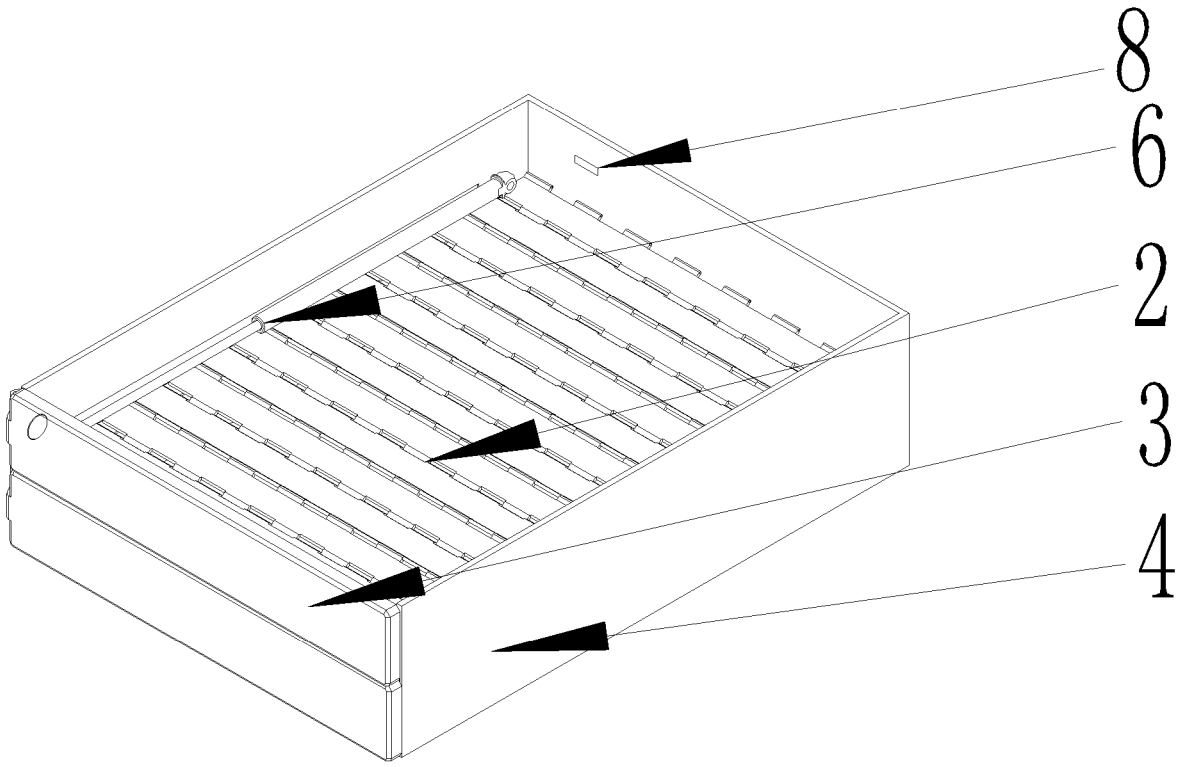
FIG. 11 illustrates a schematic diagram when separators are of a foldable and automatic foldable structure in a specific application instance.
Figure 12:
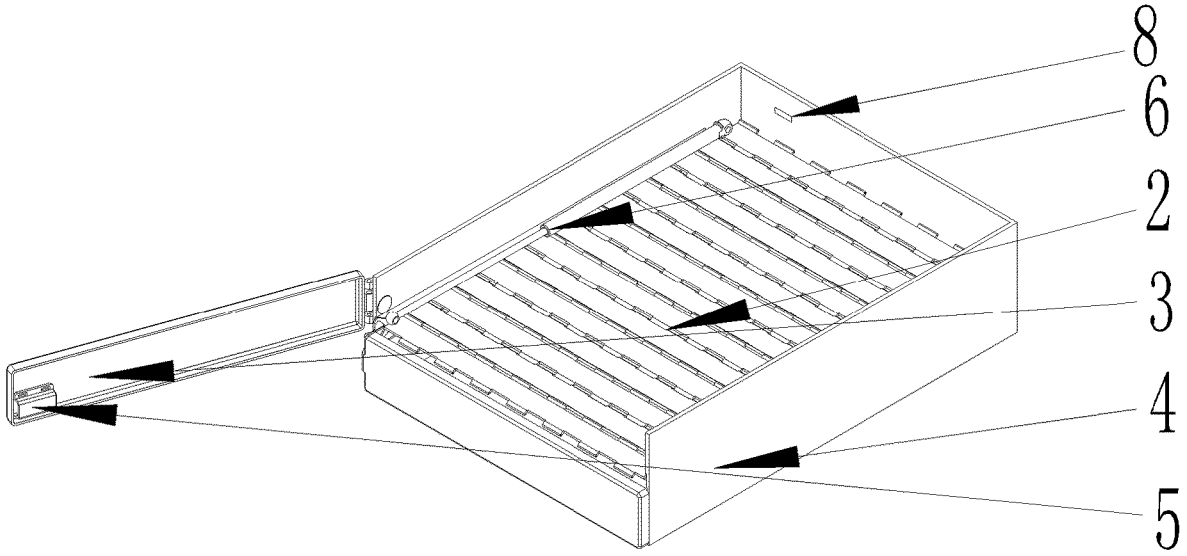
FIG. 12 illustrates a schematic diagram when separators are of a foldable and automatic foldable structure and single door is opened in a specific application instance.
Figure 13:
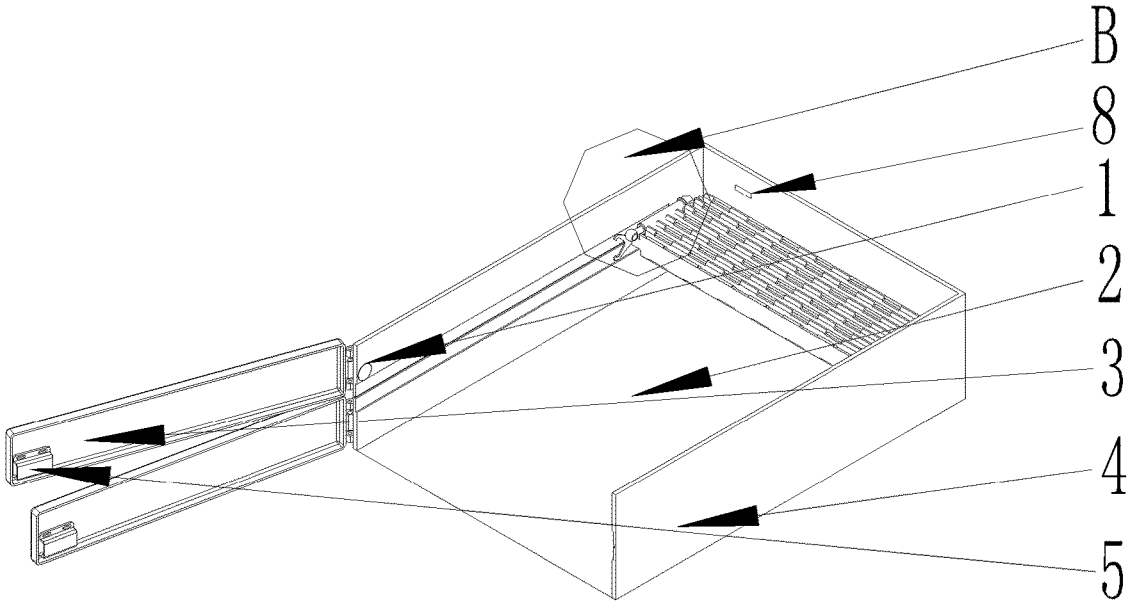
FIG. 13 illustrates a schematic diagram when separators are of a foldable structure and separators are folded in a specific application instance.
Figure 14:
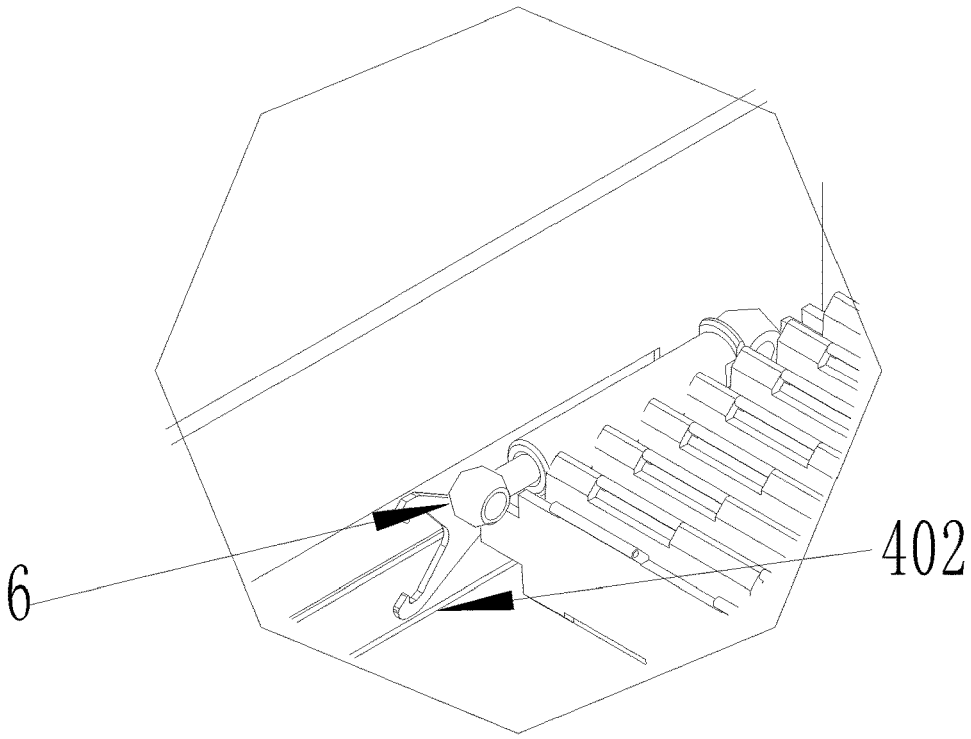
FIG. 14 illustrates a partial enlarged view of position B in FIG. 13.
Figure 15:
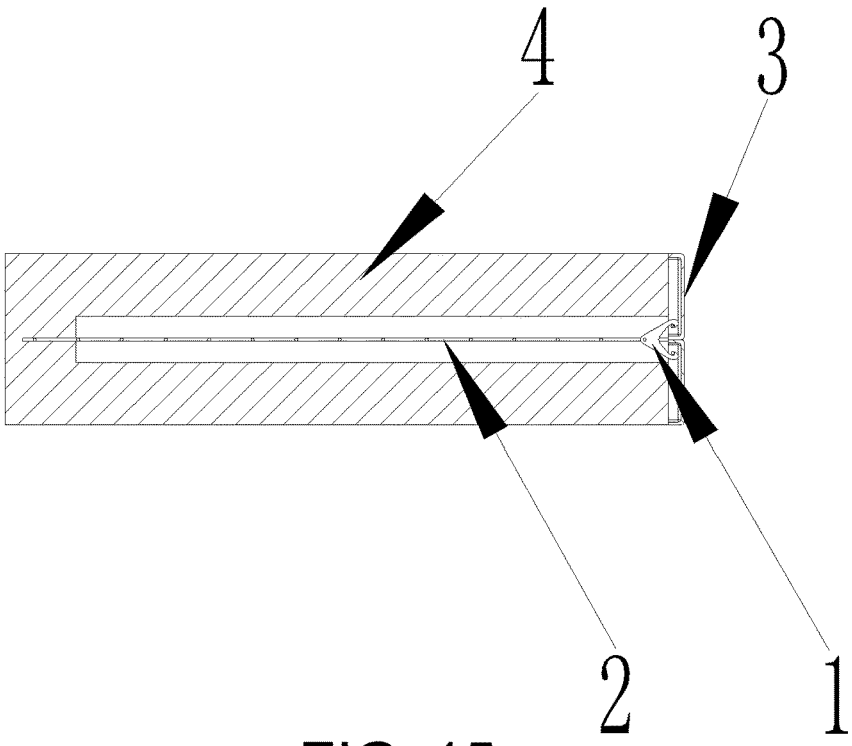
FIG. 15 illustrates a schematic diagram in which separators match separator locking parts in a specific application instance.

Referring to FIG. 5, FIG. 9 and FIG. 14, in a specific application instance, the inner side wall of the accommodating cavity 401 is provided with a hanging part 402 for hanging the separator 2, in this way, the separator 2 is hung onto the hanging part 402 after the adjacent accommodating cavities 401 are communicated, so that the separator 2 will not obstruct communication. When single accommodating cavity 401 is needed, the separator 2 is taken down from the hanging part 402, and then locked onto the separator locking part 1, so that the adjacent accommodating cavities 401 are independent closed cavities.

As shown in FIG. 6 to FIG. 10, in a specific application instance, the separator 2 may be of a folded structure or a flexible rolling shutter structure. If the rolling shutter or louver structure is applied, one end of the separator 2 are secured onto the inside wall of the accommodating cavity 401, and the other end thereof are locked by the separator locking part 1. When the separator locking part 1 is opened under the control of the control part 7, the separator 2 is folded to ensure that the adjacent accommodating cavities 401 are communicated.

The separators 2 can be folded manually. In a preferred embodiment, as shown in FIG. 11 to FIG. 15, one drive part 8 (such as drive motor) and an electronic telescopic link 6 can be provided as well. Under the control of the control part 7, the drive part 8 and the electronic telescopic link 6 will drive the separators 2 to finish folding or opening action.

Figure 16:
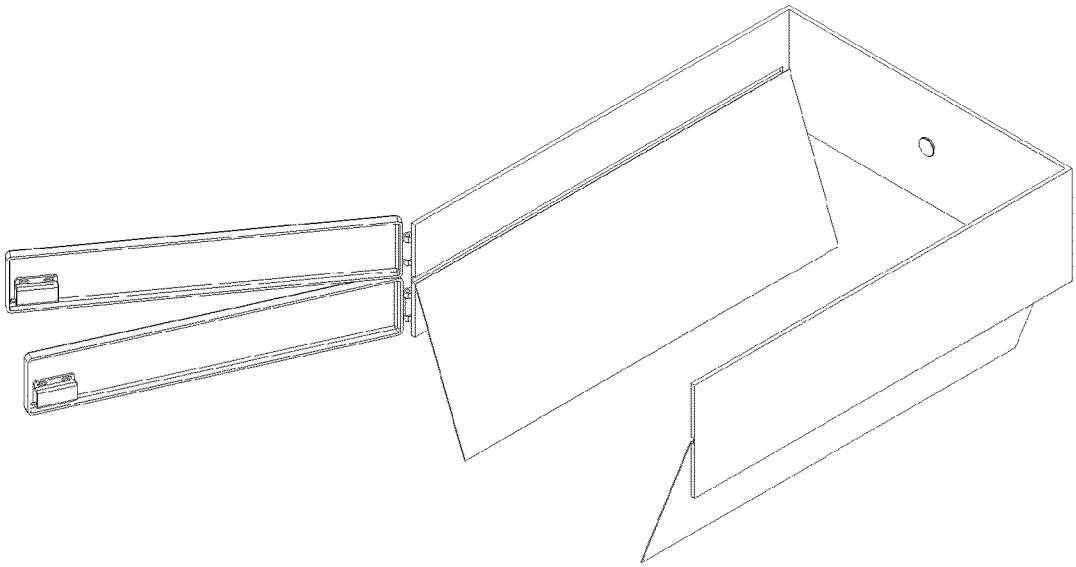
FIG. 16 illustrates a schematic diagram when separators are designed to be separable in a specific application instance.

Referring to FIG. 16, in a specific application instance, the separator 2 may be of a middle part separating structure, namely, a middle part of the separator 2 can be locked, and after unlocked, can be separated into two separating pieces which automatically drop to ensure that the adjacent accommodating cavities 401 are communicated.

Figure 17:
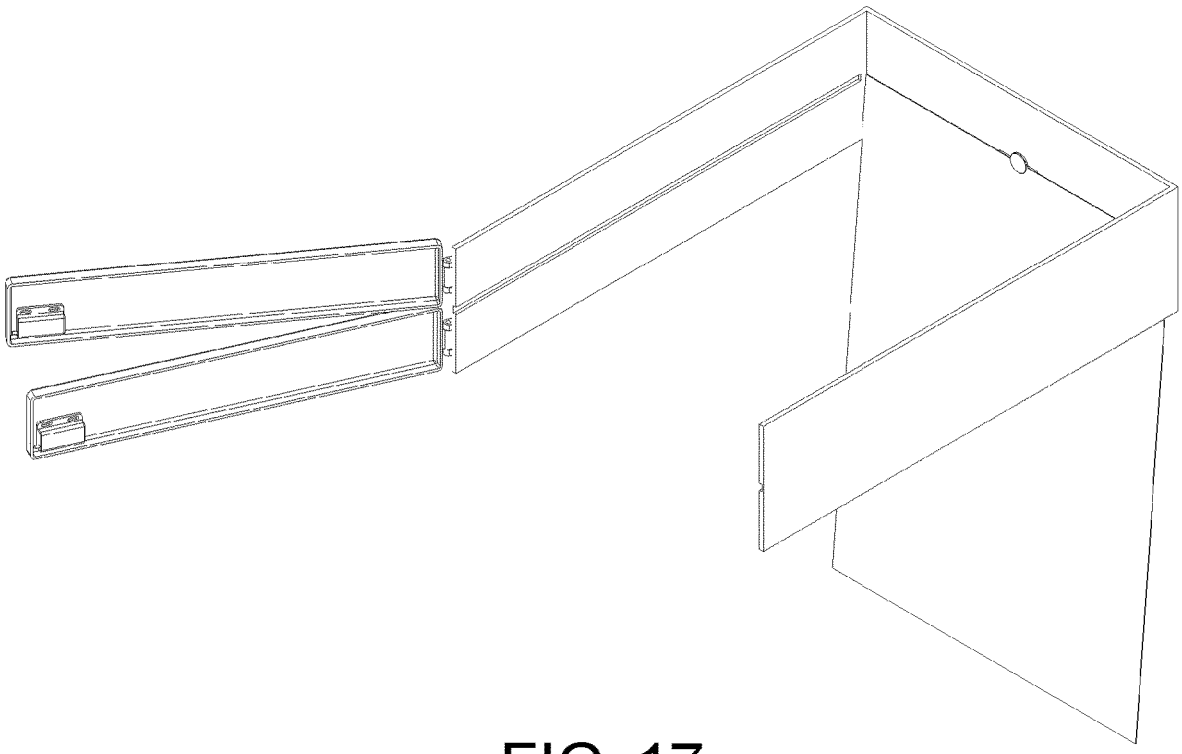
FIG. 17 illustrates a schematic diagram in which separators are of a single side hanging type structure in a specific application instance.

Referring to FIG. 17, in a specific application instance, the separator 2 can be of an end part falling structure, one end part of the separator 2 can be locked, and after unlocked, can automatically fall to ensure that the adjacent accommodating cavities 401 are communicated.

In a specific application instance, the separator 2 can be of a splicing structure hinged with a plurality of boards, one end of the separator 2 are secured onto the inside wall of the accommodating cavities 401, and the other end of the separator 2 are locked by the separator locking parts 1. When the separator locking parts 1 are opened under the control of the control part 7, the separators 2 are folded by hinged points to ensure that the adjacent accommodating cavities 401 are communicated.

In a specific application instance, the separator locking parts 1 and the door locking parts 5 can be in a linkage mode, namely, the separator locking parts 1 are opened synchronously after the adjacent door locking parts 5 are opened. Conversely, after the adjacent door locking parts 5 are locked, the separator locking parts 1 are locked synchronously. It can be comprehended that the separator locking parts 1 and the door locking parts 5 can be controlled independently and respectively, that is, the separator locking parts 1 and the door locking parts 5 are required to be controlled independently and respectively.

According to the actual needs, the separator locking parts 1 and the door locking parts 5 can be controlled by the control part 7; or the door locking parts 5 can be controlled by the control part 7, while the separator locking parts 1 can be controlled manually.

In this embodiment, the control part 7 is directly mounted on the cabinet body 4. In other embodiments, remote control or cloud control can be also applied to the control part 7, a wireless control module is only arranged on the cabinet 4 connected with the control part 7 located outside the cabinet body 4 through the wireless control module, so as to control the separator locking parts 1 and the door locking parts 5.

According to the actual needs in a specific application, electromagnetic or mechanical locks can be applied to the door locking parts 5. In this embodiment, the lock cylinders are of a telescopic structure and are mounted on the cabinet body 4 or the doors 3. Under the control of the control part 7, the lock cylinders move telescopically to match the lock catches for the purpose of finishing locking or opening action. The lock catches are correspondingly arranged on the door 3 or the cabinet body 4 according to the actual needs.

In a specific application instance, the same volume of all accommodating cavities 401 can be selected, so that grid layers with the standard specifications are formed. The different volumes of the accommodating cavities 401 can be selected, namely, the cavities that meet different demands can be formed by combining the several specifications of volumes of the adjacent accommodating cavities 401, so as to conform to the actual space requirements for different articles.

It can be understood that one part of adjacent accommodating cavities 401 can be communicated (like the present invention) on the grid cabinet, and the other part of the accommodating cavities have fixed volumes, which should fall into the protection scope of the present invention as well.

The grid cabinet with variable spaces provided by the present invention can be extensively applied as express cabinet and logistic box in the fields of express, logistics and warehousing. It can be understood that both fixed mounting and vehicle mounted modes can be applied. According to the present invention, the proper storage cavities can be used for maximally placing the articles with the corresponding volumes, which greatly optimizes the storage capacity, conforms to the actual storage demands, and improves the storage efficiency.

When in use, taking an application of the present invention as the express cabinet for example, a deliveryman will choose the required accommodation space according to the size of the goods. If the size of the goods is only applicable to one specification of accommodating cavity 401, the door 3 of one accommodating cavity 401 is opened by virtue of a control screen or an App on a mobile phone. If the size of the goods is only applicable to the volume of the combined accommodating cavities 401 with two or more specifications, the doors 3 of several adjacent accommodating cavities 401 are opened synchronously by a control screen or the App on the mobile phone, and then the separators 2 are folded to communicate with a plurality of accommodating cavities 401. A person who takes away the goods returns and locks the separators 2 to recover the design of each original accommodating cavity 401 as an independent space.

The above are only preferred embodiments of the present invention, and the protection scope of the present invention is not limited to the embodiments mentioned above. The technical solutions under the ideas of the present invention fall into the protection scope of the present invention. It should be pointed out that, for an ordinary person skilled in the art, some improvements and modifications without departing from the principle of the present invention shall be deemed as the protection scope of the present invention.

What is claimed is:

1. A grid cabinet with variable spaces, the grid cabinet comprising a cabinet body and a control part, wherein the cabinet body is provided with two or more accommodating cavities for placing articles, each of the accommodating cavities is provided with at least one door, and a door locking part is disposed on the door; a separator is disposed between every adjacent accommodating cavities, the adjacent accommodating cavities are separated into respective independent spaces by the separators, and a separator locking part for fixing and locking the separator is provided in each of the accommodating cavities; under control of the control part, the door locking parts of two or more adjacent accommodating cavities are opened synchronously, the separator locking parts are loosened, and the separators are operated so that the two or more adjacent accommodating cavities are communicated, wherein the separator is of a splicing structure hinged with a plurality of boards, one end of the separator is secured onto an inside wall of each of the accommodating cavities, and the other end of the separator is locked by the separator locking part; when the separator locking part is opened under the control of the control part, the separator is folded by hinged joints to ensure that the adjacent accommodating cavities are communicated.

2. The grid cabinet with the variable spaces according to claim 1, wherein the inside wall of each of the accommodating cavities is provided with a hanging parts for hanging the separator, and the separator is hung onto the hanging part after the adjacent accommodating cavities are communicated.

3. The grid cabinet with the variable spaces according to claim 1, wherein the separator is of a folded structure or a flexible rolling shutter structure; one end of the separator is secured onto the inside wall of each of the accommodating cavities, and the other end of the separator is locked by the separator locking part; when the separator locking part is opened under the control of the control part, the separator is folded to ensure that the adjacent accommodating cavities are communicated.

4. The grid cabinet with the variable spaces according to claim 3, wherein the separators are driven to be folded by a drive part.

5. The grid cabinet with the variable spaces according to claim 1, wherein the door locking part is an electromagnetic lock or a mechanical lock.

6. The grid cabinet with the variable spaces according to claim 5, wherein the door locking part includes a lock cylinder and a lock catch, both of which are correspondingly disposed on the door or the cabinet body respectively; the lock cylinder is of a telescopic structure and is disposed on the cabinet body or the door, and under the control of the control part, the lock cylinder moves telescopically to match the lock catch for the purpose of finishing locking or opening action.

7. The grid cabinet with the variable spaces according to claim 1, wherein the separator locking part is an electromagnetic lock, or a mechanical lock, or a manual connection component.

8. The grid cabinet with the variable spaces according to claim 1, wherein the adjacent accommodating cavities are disposed sequentially in a horizontal direction, and the plurality of separators are disposed to form separation in a vertical direction; or, the adjacent accommodating cavities are disposed sequentially in the vertical direction, and the plurality of separators are disposed to form separation in the horizontal direction, and are meanwhile to be taken as bearing plates for articles.

9. The grid cabinet with the variable spaces according to claim 1, wherein the control part is directly arranged on the cabinet body; or the control part is used for controlling the separator locking parts and the door locking parts by means of remote control or cloud control.

* * * * *